US010683649B2

(12) United States Patent
Thomas

(10) Patent No.: US 10,683,649 B2
(45) Date of Patent: Jun. 16, 2020

(54) DRAIN UN-CLOGGING ASSEMBLY

(71) Applicant: Josy Thomas, Mississauga (CA)

(72) Inventor: Josy Thomas, Mississauga (CA)

( * ) Notice: Subject to any disclaimer, the term of this patent is extended or adjusted under 35 U.S.C. 154(b) by 121 days.

(21) Appl. No.: 15/902,029

(22) Filed: Feb. 22, 2018

(65) Prior Publication Data

US 2019/0257062 A1 Aug. 22, 2019

(51) Int. Cl.

| | |
|---|---|
| ***E03C 1/302*** | (2006.01) |
| ***E03F 9/00*** | (2006.01) |
| ***B08B 9/027*** | (2006.01) |
| ***B08B 9/045*** | (2006.01) |
| ***E03C 1/30*** | (2006.01) |
| ***E03D 9/00*** | (2006.01) |

(52) U.S. Cl.

CPC ..... *E03C 1/302* (2013.01); *B08B 9/027* (2013.01); *B08B 9/045* (2013.01); *E03C 1/30* (2013.01); *E03D 9/00* (2013.01); *E03F 9/002* (2013.01); *E03F 9/005* (2013.01)

(58) Field of Classification Search

CPC .. E03C 1/30; E03C 1/302; E03F 9/002; E03F 9/005; B08B 9/027; B08B 9/04; B08B 9/043; B08B 9/0436; B08B 9/045

USPC ..... 15/104.05, 104.09, 104.095, 15/104.31–104.33; 4/255.01

See application file for complete search history.

(56) References Cited

U.S. PATENT DOCUMENTS

| | | | | |
|---|---|---|---|---|
| 2,625,699 | A * | 1/1953 | Jurasevich | E03F 9/005 15/104.33 |
| 3,460,149 | A | 8/1969 | McMahon | |
| 4,793,017 | A * | 12/1988 | Kaye | E03F 9/005 15/104.33 |
| 5,307,534 | A | 5/1994 | Miller | |
| D356,213 | S | 3/1995 | Chaves | |
| 5,649,334 | A * | 7/1997 | Henriquez | A46B 13/04 15/29 |
| 5,809,601 | A | 9/1998 | Rivera | |
| 7,356,867 | B1 | 4/2008 | Beiermann | |
| 8,434,185 | B1 | 5/2013 | Beaver, Sr. | |
| 9,371,637 | B1 | 6/2016 | Chen et al. | |
| 2008/0313831 | A1 * | 12/2008 | Kovach | B08B 9/0436 15/25 |
| 2014/0115802 | A1 | 5/2014 | Yu | |
| 2016/0244958 | A1 | 8/2016 | Wule | |

FOREIGN PATENT DOCUMENTS

DE 2613944 * 10/1977

* cited by examiner

*Primary Examiner* — Mark Spisich

(57) ABSTRACT

A drain un-clogging assembly for un-clogging a drain includes a handle and a rotation unit that is coupled to the handle. The rotation unit is extendable into a clogged drain. Additionally, the rotation unit is comprised of a flexible material to conform to curves in the clogged drain. The rotation unit rotates when the rotation unit is turned on to frictionally engage debris in the clogged drain. In this way the debris may be removed from the clogged drain without chemicals or a plumber.

8 Claims, 5 Drawing Sheets

DRAIN UN-CLOGGING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to un-clogging devices and more particularly pertains to a new un-clogging device for un-clogging a drain.

BRIEF SUMMARY OF THE INVENTION

An embodiment of the disclosure meets the needs presented above by generally comprising a handle and a rotation unit that is coupled to the handle. The rotation unit is extendable into a clogged drain. Additionally, the rotation unit is comprised of a flexible material to conform to curves in the clogged drain. The rotation unit rotates when the rotation unit is turned on to frictionally engage debris in the clogged drain. In this way the debris may be removed from the clogged drain without chemicals or a plumber.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
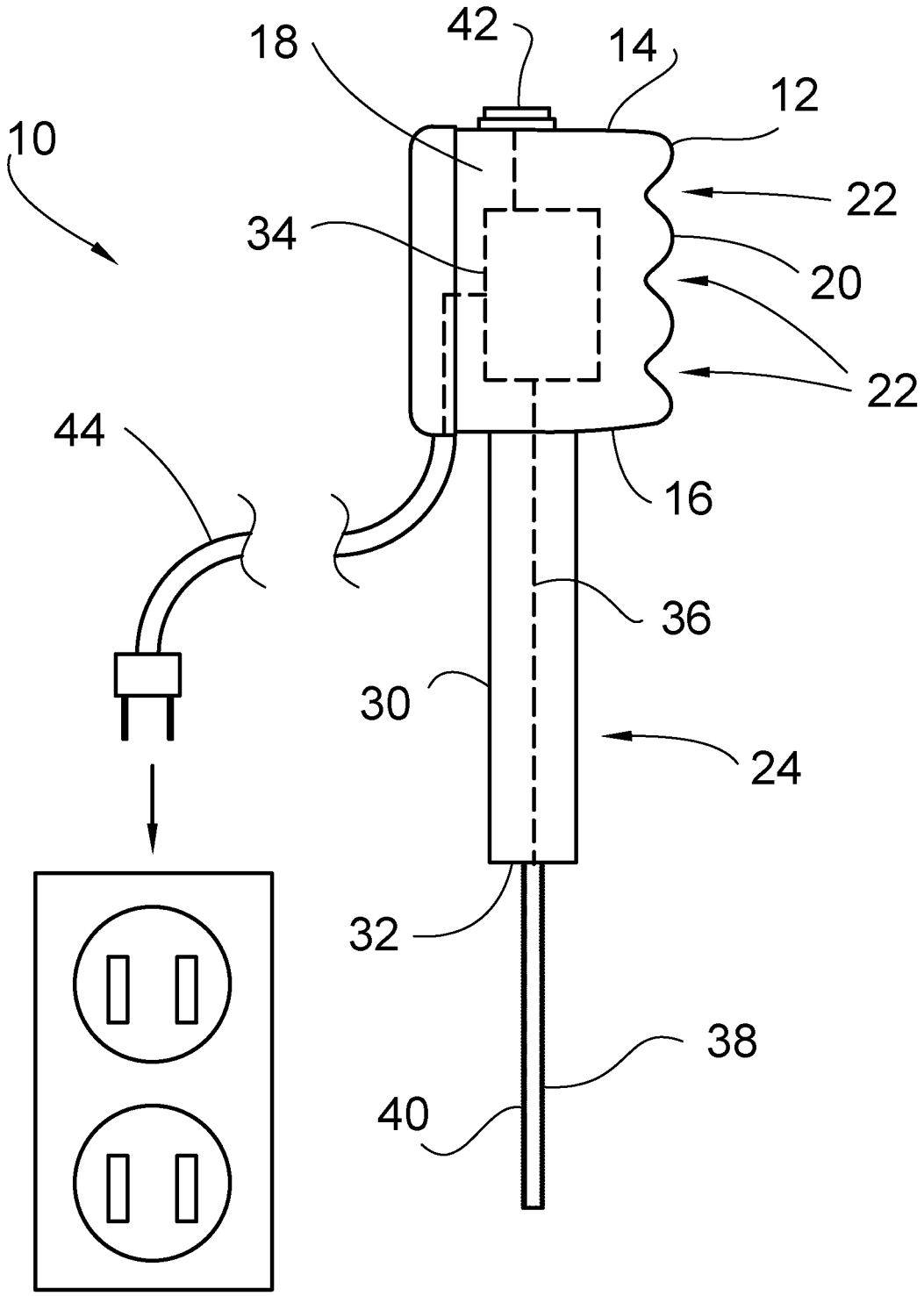
FIG. 1 is a right side phantom view of a drain un-clogging assembly according to an embodiment of the disclosure.
Figure 2:
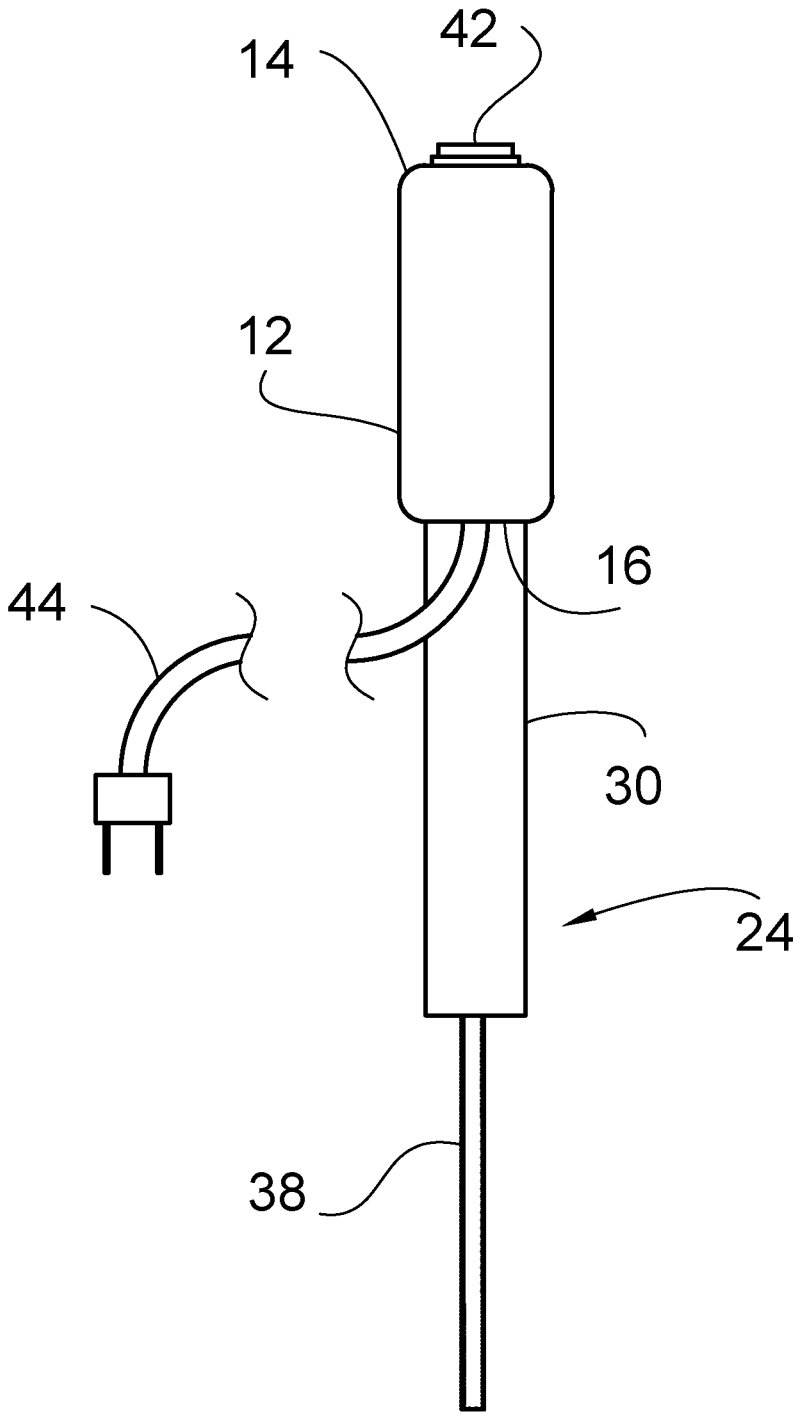
FIG. 2 is a front view of an embodiment of the disclosure.
Figure 3:
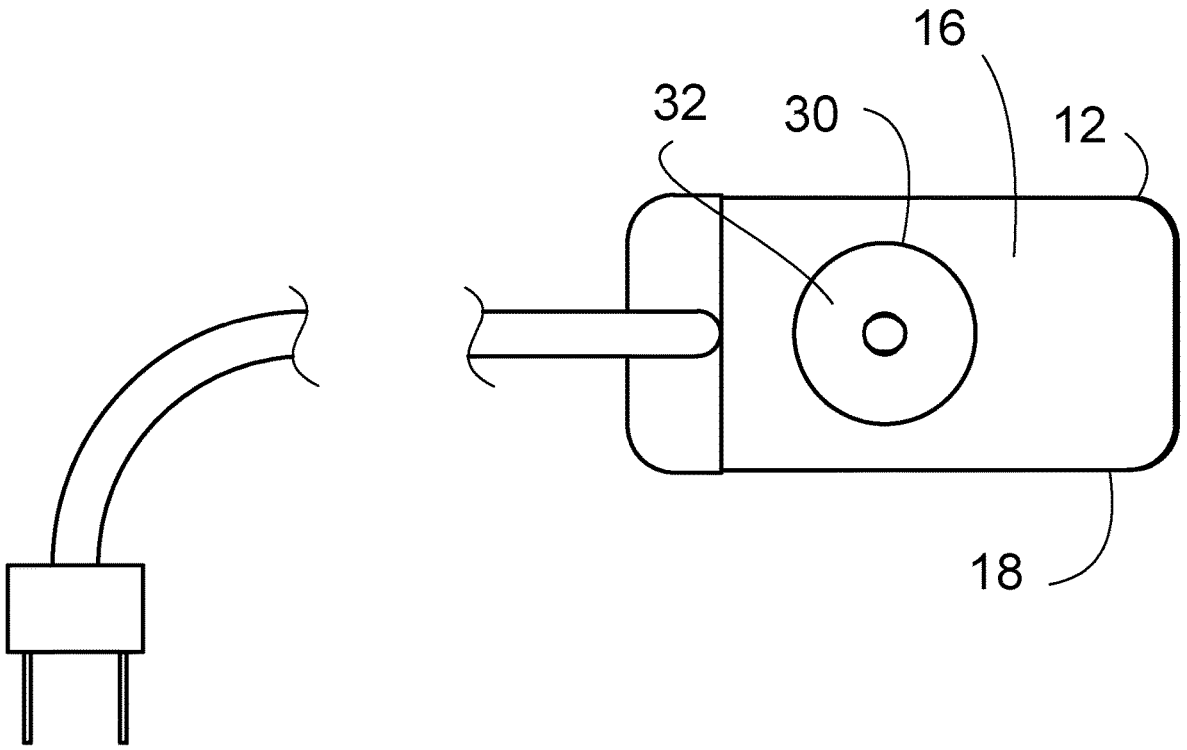
FIG. 3 is a bottom view of an embodiment of the disclosure.
Figure 4:
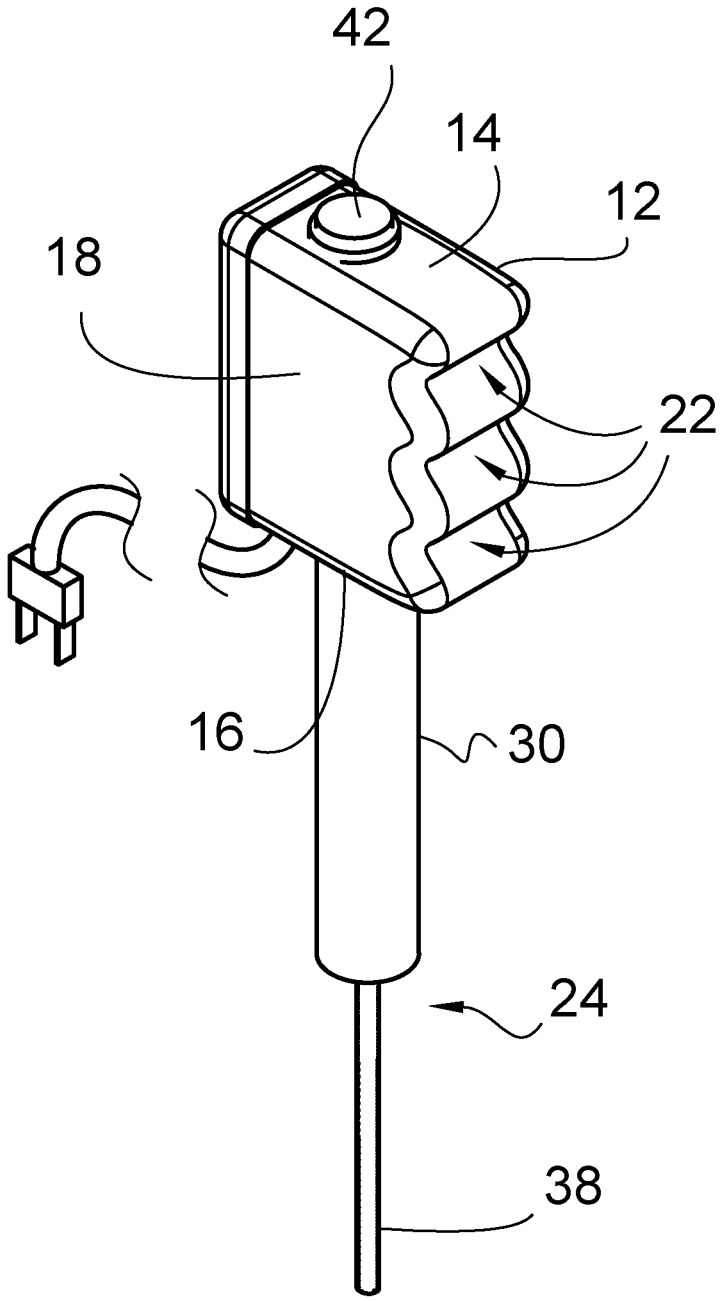
FIG. 4 is a perspective view of an embodiment of the disclosure.
Figure 5:
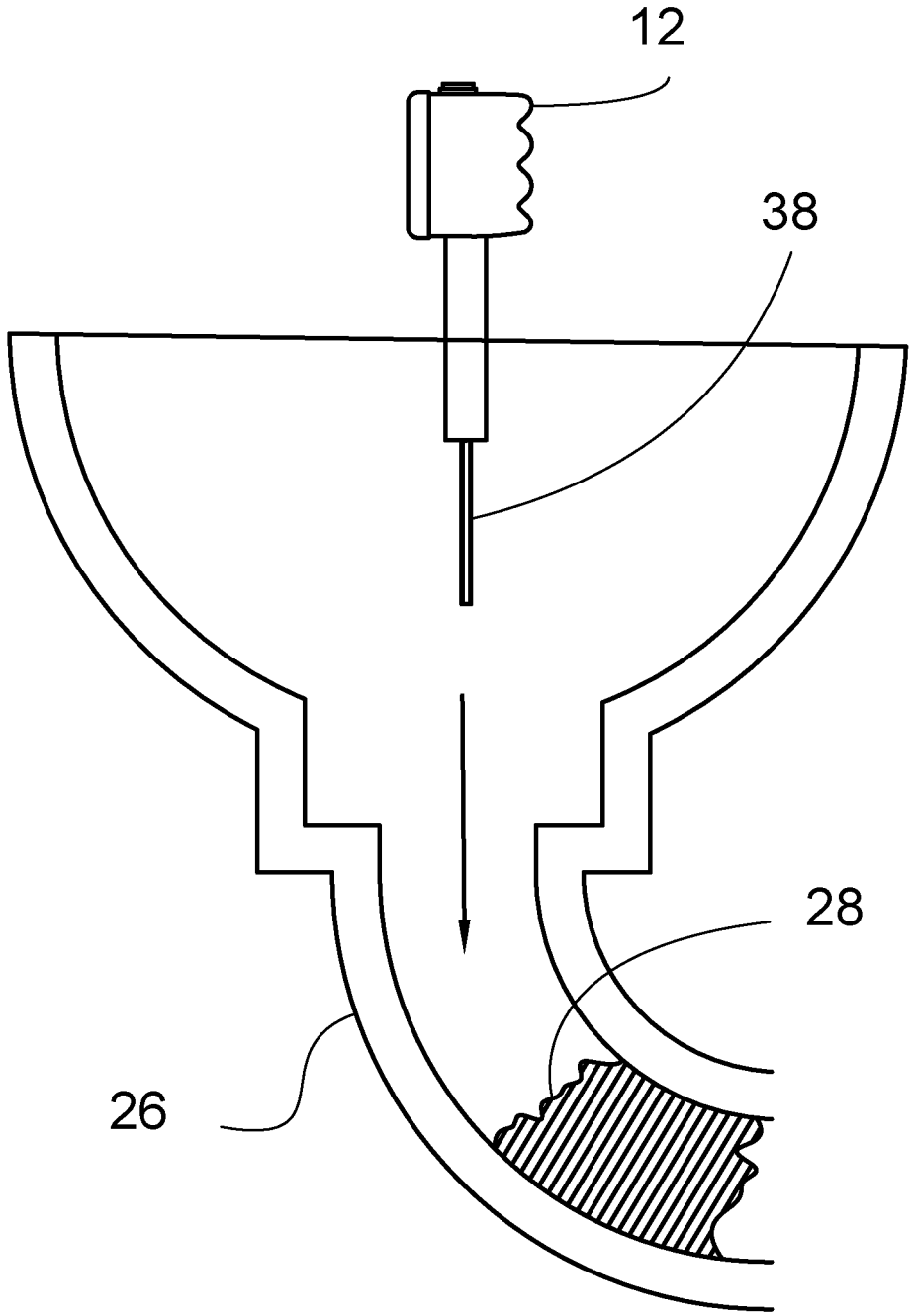
FIG. 5 is a perspective in-use view of an embodiment of the disclosure.

With reference now to the drawings, and in particular to FIGS. 1 through 5 thereof, a new un-clogging device embodying the principles and concepts of an embodiment of the disclosure and generally designated by the reference numeral 10 will be described.

As best illustrated in FIGS. 1 through 5, the drain un-clogging assembly 10 generally comprises a handle 12 that has a first end 14, a second end 16 and an outer wall 18 extending therebetween. The outer wall 18 has a first side 20 and the first side 20 undulates between the first end 14 and the second end 16 to define a plurality of grips 22. Each of the grips 22 receives fingers when the handle 12 is gripped. The handle 12 may be encased in a resiliently compressible material, such as foam rubber or the like, to enhance comfort when gripping the handle 12.

A rotation unit 24 is coupled to the handle 12 and the rotation unit 24 is extendable into a clogged drain 26. The clogged drain 26 may be a drain on a bathroom sink, a kitchen sink and any other drain for a plumbing fixture in a building. The rotation unit 24 is comprised of a flexible, non-metallic material such as rubber or the like. Thus, the rotation unit 24 can conform to curves in the clogged drain 26. The rotation unit 24 rotates when the rotation unit 24 is turned on to frictionally engage debris 28, especially hair and the like, that is lodged in the clogged drain 26. In this way the clogged drain 26 may be un-clogged without the use of chemicals or a professional plumber.

The rotation unit 24 comprises a shaft 30 that is coupled to and extends away from the second end 16 of the handle 12. The shaft 30 has a distal end 32 with respect to the handle 12 and the shaft 30 may have a length of at least 13.0 cm. A motor 34 is positioned within the handle 12 and the motor 34 is aligned with the shaft 30. The motor 34 may be an electric motor 34 or the like.

A drive 36 is provided and the drive 36 is rotatably positioned within the shaft 30. The drive 36 extends through the distal end 32 of the shaft 30 and the second end 16 of the handle 12. Moreover, the drive 36 is rotatably coupled to the motor 34 such that the motor 34 rotates the drive 36 when the motor 34 is turned on. The drive 36 may be a drive 36 shaft 30 or other rotational drive conventional to cordless drills or the like.

A drill bit 38 is rotatably coupled to and extends away from the distal end 32 of the shaft 30 and the drill bit 38 is oriented co-linear with an axis extending through the distal end 32 of the shaft 30 and the second end 16 of the handle 12. The drill bit 38 is comprised of a flexible and nonmetallic material. Moreover, the drill bit 38 is rotatably coupled to the drive 36 such that the drive 36 rotates the drill bit 38 when the motor 34 is turned on. The drill bit 38 has an outer surface 40 and the outer surface 40 is textured to frictionally engage the debris 28 in the clogged drain 26. The drill bit 38 may have a length of at least 10.0 cm.

A button 42 is coupled to the first end 14 of the handle 12 and the button 42 is electrically coupled to the motor 34 to turn the motor 34 on and off. A power cord 44 is coupled to and extends away from the handle 12 and the power cord 44 is electrically coupled to the motor 34. The power cord 44 is electrically coupled to a power source, such as a female electrical outlet or the like.

In use, the power cord 44 is plugged into the power source and the drill bit 38 is directed downwardly into the clogged drain 26. The button 42 is manipulated to turn the motor 34 on and the drill bit 38 rotates, thereby frictionally engaging the debris 28 in the clogged drain 26. The debris 28 becomes twisted around the drill bit 38 thereby facilitating the debris 28 to be lifted out of the drain. In this way the clogged drain 26 may be un-clogged without chemicals, a plunger or a professional plumber. The debris 28 is removed from the drill bit 38 when the drill bit 38 is removed from the drain.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drain un-clogging assembly being configured to remove debris from a clogged drain, said assembly comprising:

a handle, said handle having a first end, a second end and an outer wall extending therebetween, said outer wall having a first side, said first side undulating between said first end and said second end to define a plurality of grips aligned along said first side for receiving fingers when said handle is gripped;

a motor being positioned within said handle; and a rotation unit being coupled to said handle wherein said rotation unit is configured to be extendable into a clogged drain, said rotation unit being comprised of a flexible material wherein said rotation unit is configured to conform to curves in the clogged drain, said rotation unit rotating relative to said handle when said motor is turned on wherein said rotation unit is configured to frictionally engage debris in the clogged drain for removal, said rotation unit comprising a shaft being coupled to and extending away from said handle, said shaft being oriented to extend from said handle parallel to said first side wherein said plurality of grips is parallel to said shaft, said shaft being rotated relative to said handle when said motor is activated.

2. The assembly according to claim 1, wherein said rotation unit comprises said shaft being coupled to and extending away from said second end of said handle, said shaft having a distal end with respect to said handle.

3. The assembly according to claim 2, further comprising a drive being rotatably positioned within said shaft, said drive extending through said distal end of said shaft and said second end of said handle, said drive being rotatably coupled to said motor such that said motor rotates said drive when said motor is turned on.

4. The assembly according to claim 3, wherein said rotation unit further comprises a drill bit being rotatably coupled to and extending away from said distal end of said shaft, said drill bit being oriented co-linear with an axis extending through said distal end of said shaft and said second end of said handle, said drill bit being comprised of a flexible and nonmetallic material.

5. The assembly according to claim 4, wherein said drill bit is rotatably coupled to said drive such that said drive rotates said drill bit when said motor is turned on, said drill bit having an outer surface, said outer surface being textured wherein said drill bit is configured to frictionally engage the debris in the clogged drain.

6. The assembly according to claim 1, further comprising a button being coupled to said first end of said handle wherein said button is configured to be manipulated, said button being electrically coupled to said motor such that said button turns said motor on and off, said button being positioned on said handle such that said button is manipulated by being pushed towards said shaft.

7. The assembly according to claim 1, further comprising a power cord being coupled to and extending away from said handle, said power cord being electrically coupled to said motor, said power cord being configured to be electrically coupled to a power source.

8. A drain un-clogging assembly being configured to remove debris from a clogged drain, said assembly comprising:

a handle having a first end, a second end and an outer wall extending therebetween, said outer wall having a first side, said first side undulating between said first end and said second end to define a plurality of grips for receiving fingers when said handle is gripped;

a motor being positioned within said handle;

a button being coupled to said first end of said handle wherein said button is configured to be manipulated, said button being electrically coupled to said motor such that said button turns said motor on and off;

a rotation unit being coupled to said handle wherein said rotation unit is configured to be extendable into a clogged drain, said rotation unit being comprised of a flexible material wherein said rotation unit is configured to conform to curves in the clogged drain, said rotation unit rotating relative to said handle when said motor is turned on wherein said rotation unit is configured to frictionally engage debris in the clogged drain for removal, said rotation unit comprising:

a shaft being coupled to and extending away from said second end of said handle, said shaft being oriented to extend from said handle parallel to said first side wherein said plurality of grips is parallel to said shaft, said shaft having a distal end with respect to said handle, said button being positioned on said handle such that said button is manipulated by being pushed towards said shaft;

a drive being rotatably positioned within said shaft, said drive extending through said distal end of said shaft and said second end of said handle, said drive being rotatably coupled to said motor such that said motor rotates said drive when said motor is turned on; and a drill bit being rotatably coupled to and extending away from said distal end of said shaft, said drill bit being oriented co-linear with an axis extending through said distal end of said shaft and said second end of said handle, said drill bit being comprised of a flexible and nonmetallic material, said drill bit being rotatably coupled to said drive such that said drive rotates said drill bit when said motor is turned on, said drill bit having an outer surface, said outer surface being textured wherein said drill bit is configured to frictionally engage the debris in the clogged drain; and a power cord being coupled to and extending away from said handle, said power cord being electrically coupled to said motor, said power cord being configured to be electrically coupled to a power source.

* * * * *